US008260180B2

(12) United States Patent
Sekiya

(10) Patent No.: US 8,260,180 B2
(45) Date of Patent: Sep. 4, 2012

(54) IMAGE FORMING APPARATUS

(75) Inventor: Takeshi Sekiya, Abiko (JP)

(73) Assignee: Canon Kabushiki Kaisha (JP)

( * ) Notice: Subject to any disclaimer, the term of this patent is extended or adjusted under 35 U.S.C. 154(b) by 292 days.

(21) Appl. No.: 12/814,185

(22) Filed: Jun. 11, 2010

(65) Prior Publication Data

US 2011/0002717 A1 Jan. 6, 2011

(30) Foreign Application Priority Data

Jul. 6, 2009 (JP) ..... 2009-159900

(51) Int. Cl.
*G03G 15/01* (2006.01)

(52) U.S. Cl. ..... 399/299; 399/66; 399/302

(58) Field of Classification Search ..... 399/66, 399/299, 302
See application file for complete search history.

(56) References Cited

U.S. PATENT DOCUMENTS 6,061,542 A * 5/2000 Minami et al. ..... 399/299
2008/0003028 A1* 1/2008 Kuroki et al. ..... 399/329
2008/0219720 A1* 9/2008 Matsumoto ..... 399/318
2010/0080597 A1* 4/2010 Seki et al. ..... 399/66

FOREIGN PATENT DOCUMENTS

JP 2005-156776 A 6/2005

* cited by examiner

*Primary Examiner* — David Gray
*Assistant Examiner* — Francis Gray
(74) *Attorney, Agent, or Firm* — Rossi, Kimms & McDowell LLP

(57) ABSTRACT

An image forming apparatus starts a separation operation of separating at least one of a plurality of image bearing members and an intermediate transfer member from each other at a first speed, and when the at least one of a plurality of image bearing members and the intermediate transfer member are not separated from each other within a predetermined period of time from the start of the separation operation, the image forming apparatus performs the separation operation at a second speed lower than the first speed. With such a configuration, even when a sudden load to the separation motor occurs, a load increases due to aging degradation, etc., the occurrence of a separation operation failure of the intermediate transfer belt may be reduced to increase the service life of the image forming apparatus.

6 Claims, 5 Drawing Sheets

IMAGE FORMING APPARATUS

BACKGROUND OF THE INVENTION

1. Field of the Invention

The present invention relates to an image forming apparatus in which an image bearing member bearing a toner image and an intermediate transfer member is brought into contact with and separated from each other.

2. Description of the Related Art

Conventionally, there has been an image forming apparatuses having a plurality of photosensitive members and an intermediate transfer belt, in which color photosensitive members (photosensitive members for yellow, magenta, and cyan) that are not used during monochrome printing are separated from the intermediate transfer belt during the monochrome printing (see, for example, Japanese Patent Application Laid-Open No. 2005-156776).

According to the invention described in Japanese Patent Application Laid-Open No. 2005-156776, a separation mechanism and a separation motor for separating the color photosensitive members from the intermediate transfer belt are provided. By separating the intermediate transfer belt from the color photosensitive members during monochrome printing, abrasion and damage to the intermediate transfer belt and the color photosensitive members may be reduced, and the service life of the image forming apparatus can be increased.

However, according to the invention described in Japanese Patent Application Laid-Open No. 2005-156776, when a sudden load to the separation motor occurs due to a catch of a gear for transmitting a drive force from the separation motor during the separation operation of the intermediate transfer belt, a separation operation failure may be caused. Further, in a case where a load to the separation motor has increased due to aging degradation, a separation operation failure may also be caused.

In this case, the color photosensitive members and the intermediate transfer belt may not be separated and always contact each other even during monochrome printing. Consequently, abrasion and damage to the intermediate transfer belt and the color photosensitive members occur more than necessary, which may decrease the service life of the image forming apparatus.

SUMMARY OF THE INVENTION

An object of the present invention is to provide an image forming apparatus capable of reducing the occurrence of a separation operation failure of an intermediate transfer belt even when a sudden load to a separation motor occurs or a load increases due to aging degradation, to thereby increase the service life of the image forming apparatus.

In order to attain the above-mentioned object, according to an aspect of the present invention, an image forming apparatus includes a plurality of image bearing members configured to bear toner images, an intermediate transfer member configured to contact the plurality of image bearing members so that the toner images borne on the plurality of image bearing members respectively are transferred to the intermediate transfer member, a drive unit configured to cause at least one of the plurality of image bearing members and the intermediate transfer member to be separated from each other or to contact each other, and a control unit configured to control the drive unit so that the drive unit starts a separation operation of separating the at least one of the plurality of image bearing members and the intermediate transfer member from each other at a first speed, and when the at least one of the plurality of image bearing members and the intermediate transfer member are not separated from each other within a predetermined period of time from the start of the separation operation, the drive unit performs the separation operation at a second speed lower than the first speed.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
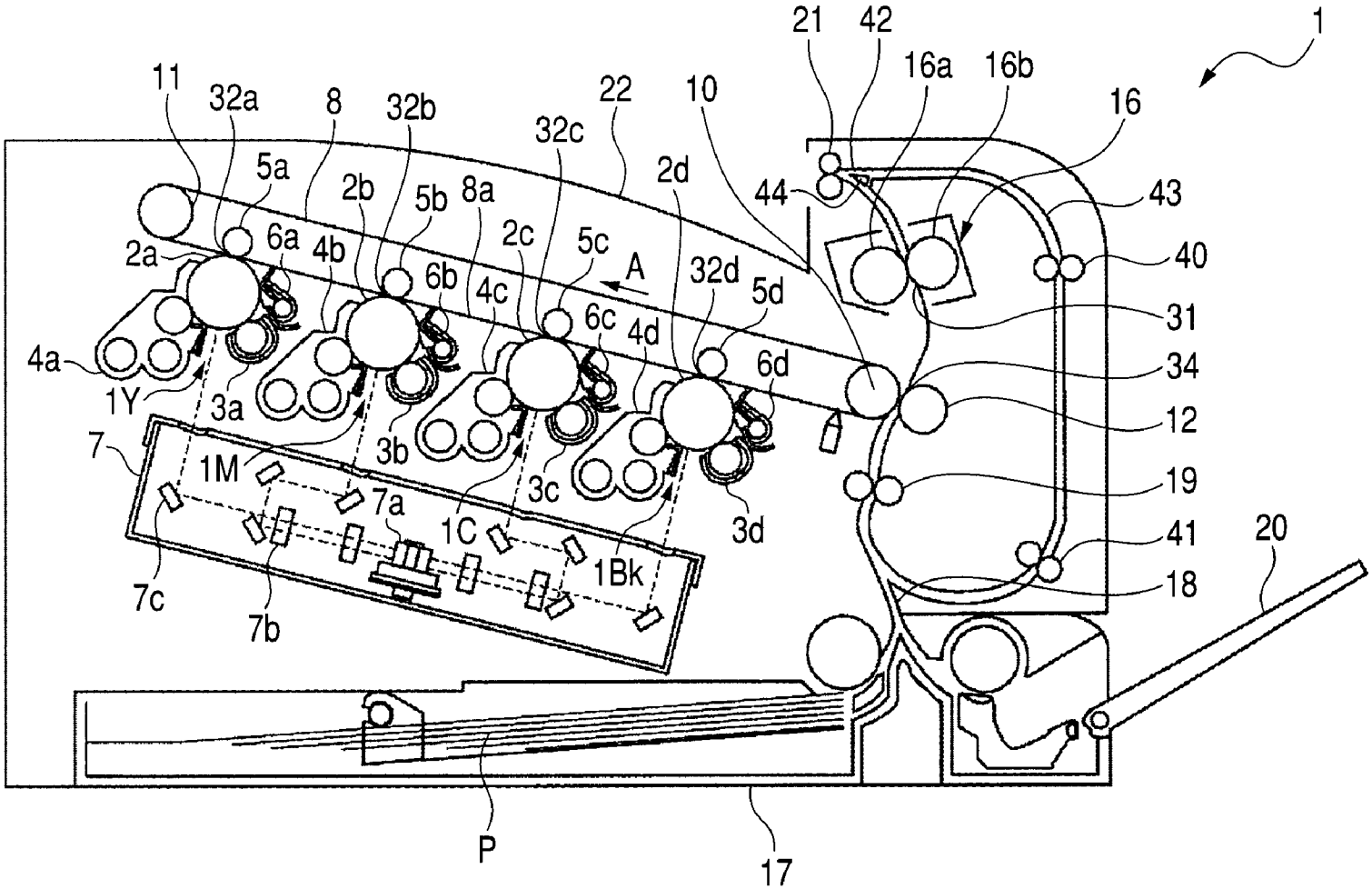
FIG. 1 is a cross-sectional view illustrating an image forming apparatus according to an embodiment of the present invention.

FIG. 1 is a cross-sectional view illustrating an image forming apparatus 1 according to an embodiment of the present invention.

The image forming apparatus 1 includes an image forming portion 1Y for forming a yellow image, an image forming portion 1M for forming a magenta image, an image forming portion 1C for forming a cyan image, and an image forming portion 1BK for forming a black image.

The image forming portions 1Y, 1M, 1C, 1BK respectively include a plurality of photosensitive drums 2*a*, 2*b*, 2*c*, 2*d* as image bearing members, primary chargers 3*a*, 3*b*, 3*c*, 3*d*, developing devices 4*a*, 4*b*, 4*c*, 4*d*, transfer rollers 5*a*, 5*b*, 5*c*, 5*d*, and drum cleaning devices 6*a*, 6*b*, 6*c*, 6*d*.

Further, a laser exposure device 7 is provided below the image forming portions 1Y, 1M, 1C, 1BK, and an endless intermediate transfer belt 8 as an intermediate transfer member is provided between the photosensitive drums 2*a* to 2*d* and transfer rollers 5*a* to 5*d*.

The primary chargers 3*a* to 3*d* uniformly charge the surfaces of the photosensitive drums 2*a* to 2*d* to a negative predetermined potential with a charging bias applied from a charging bias power source (not shown).

The developing devices 4*a* to 4*d* allow toners of respective colors to adhere to electrostatic latent images formed on the photosensitive drums 2*a* to 2*d* to develop (visualize) the electrostatic latent images as toner images. The transfer rollers 5*a* to 5*d* each contact the photosensitive drums 2*a* to 2*d* via the intermediate transfer belt 8, respectively, in the primary transfer portions 32*a* to 32*d*. The drum cleaning devices 6*a* to 6*d* each have cleaning blades or the like for removing toners remaining on the photosensitive drums 2*a* to 2*d* after primary transfer.

The laser exposure device 7 includes a laser light emitting element 7*a*, a polygon lens 7*b*, a reflective mirror 7*c*. The exposure device 7 irradiates the photosensitive drums 2*a* to 2*d* charged by the primary chargers 3*a* to 3*d*, respectively, with laser light corresponding to image data input from an external device. Consequently, an electrostatic latent image of each color corresponding to the image data is formed on the photosensitive drums 2*a* to 2*d*.

The image forming apparatus 1 further includes a secondary transfer counter roller 10, a tension roller 11, and a secondary transfer roller 12. The secondary transfer counter roller 10 contacts the secondary transfer roller 12 via the intermediate transfer belt 8 in a secondary transfer portion 34. The tension roller 11 is placed at a position opposed to the secondary transfer counter roller 10 with the primary transfer portions 32*a* to 32*d* interposed therebetween, and provides tension to the intermediate transfer belt 8.

The image forming apparatus 1 further includes a feed cassette 17, a manual feed tray 20, a transportation path 18, a registration roller 19, a fixing device 16, a discharge roller 21, a discharge tray 22, a duplex path 43, a duplex rollers 40, 41, and a flapper 44.

The feed cassette 17 and the manual feed tray 20 feed a transferring material (paper) P to the transportation path 18. The registration roller 19 transports the transferring material P along the transportation path 18. The fixing device 16 has a fixing roller 16*a* and a pressure roller 16*b*, which contact each other in a fixing nip portion 31.

The transferring material P passes through the fixing nip portion 31, and the discharge roller 21 discharges the transferring material P to the discharge tray 22 provided on an upper surface of the image forming apparatus 1. For duplex printing, after the trailing edge of the transferring material P reaches an inversion sensor 42, the position of the flapper 44 is switched to the duplex path 43 side, so that the discharge roller 21 is rotated in an opposite direction, to thereby send the transferring material P to the duplex path 43. The duplex rollers 40, 41 transport the transferring material P in the duplex path 43 and further transport the transferring material P to the registration roller 19. After an image forming operation is performed on a reverse surface, the transferring material P passes through the fixing nip portion 31, and discharged to the discharge tray 22 by the discharge roller 21.

Figure 2:
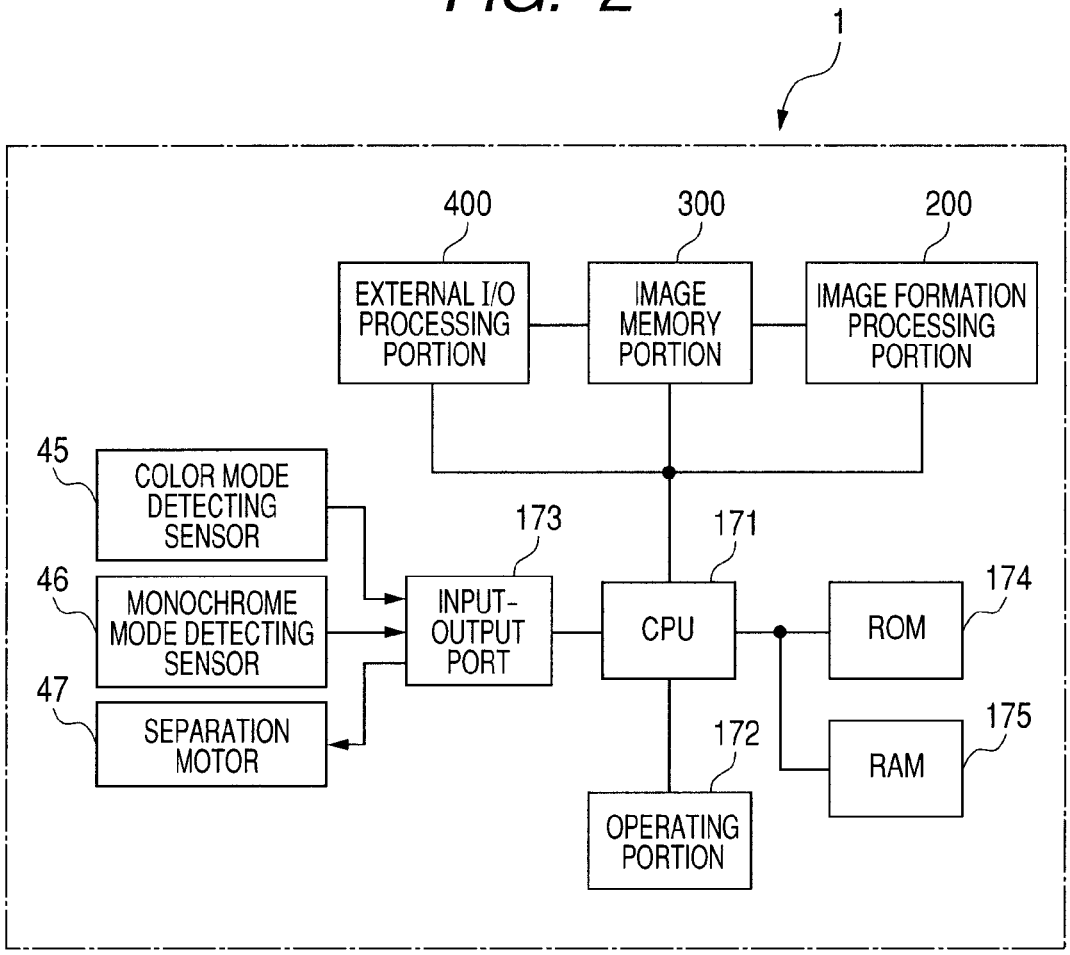
FIG. 2 is a block diagram illustrating an internal configuration of the image forming apparatus.

FIG. 2 is a block diagram illustrating an internal configuration of the image forming apparatus 1.

A CPU 171 as a control unit controls the image forming apparatus 1. A ROM 174 stores a control program to be executed by the CPU 171. A RAM 175 is a work area for the CPU 171 to perform processing.

To an input-output port 173, various motor sensors, such as a color mode detecting sensor 45, a monochrome mode detecting sensor 46, and a separation motor as a drive unit, which are described later, are connected. The CPU 171 controls the input-output of a signal via the input-output port 173 according to the control program stored in the ROM 174, to thereby perform an image forming operation.

An operating portion 172 has a display portion for displaying information regarding the image forming apparatus 1 and a key input portion. An operator uses the key input portion to instruct the CPU 171 to switch an operation mode and a display. The CPU 171 displays the state of the image forming apparatus 1 and the setting of an operation mode set by the key input, on the display portion. A user may select an image forming mode such as a color mode/monochrome mode and a single-side printing mode/double-side printing mode, using the operating portion 172.

An image formation processing portion 200 performs processing for allowing the light exposure device to emit laser light corresponding to line image data transferred from an image memory portion 300.

In the following, a separation operation in the primary transfer portions 32*a* to 32*c* in the image forming apparatus 1 will be described with reference to FIGS. 3A and 3B.

Figure 3A:
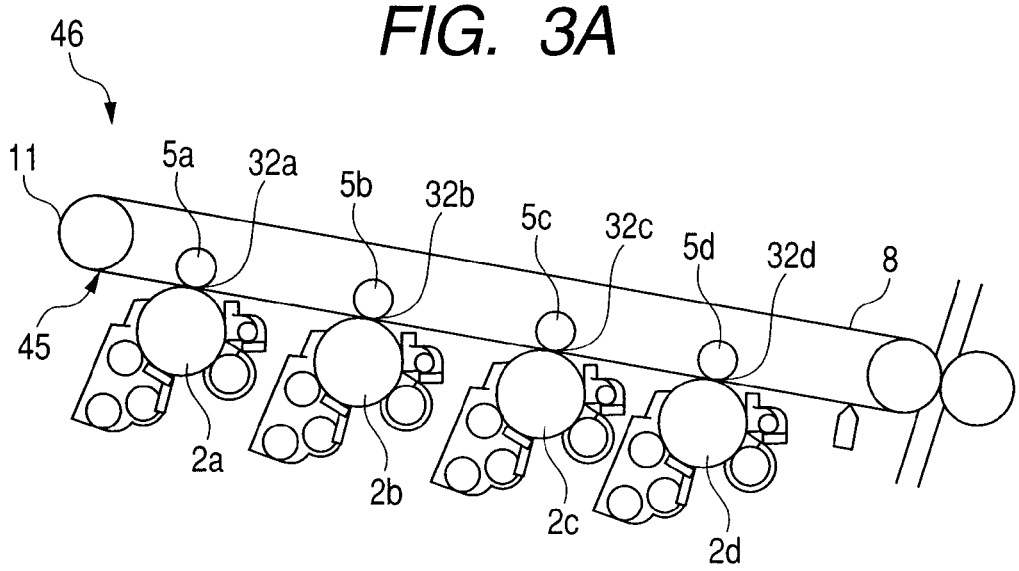
FIGS. 3A and 3B are views illustrating states of image forming portions and primary transfer portions.

FIG. 3A is a view illustrating states of image forming portions and primary transfer portions during image formation in color mode.

The transfer rollers 5*a* to 5*d* contact and press the respective photosensitive drums 2*a* to 2*d* via the intermediate transfer belt 8 in the respective primary transfer portions 32*a* to 32*d*.

When the photosensitive drums 2*a* to 2*c* contact the intermediate transfer belt 8, the color mode detecting sensor 45 is turned on to send a detection signal to the CPU 171. When a high-voltage bias is applied to the primary transfer portions 32*a* to 32*d*, the toner images on the photosensitive drums 2*a* to 2*d* are transferred to the intermediate transfer belt 8.

Figure 3B:
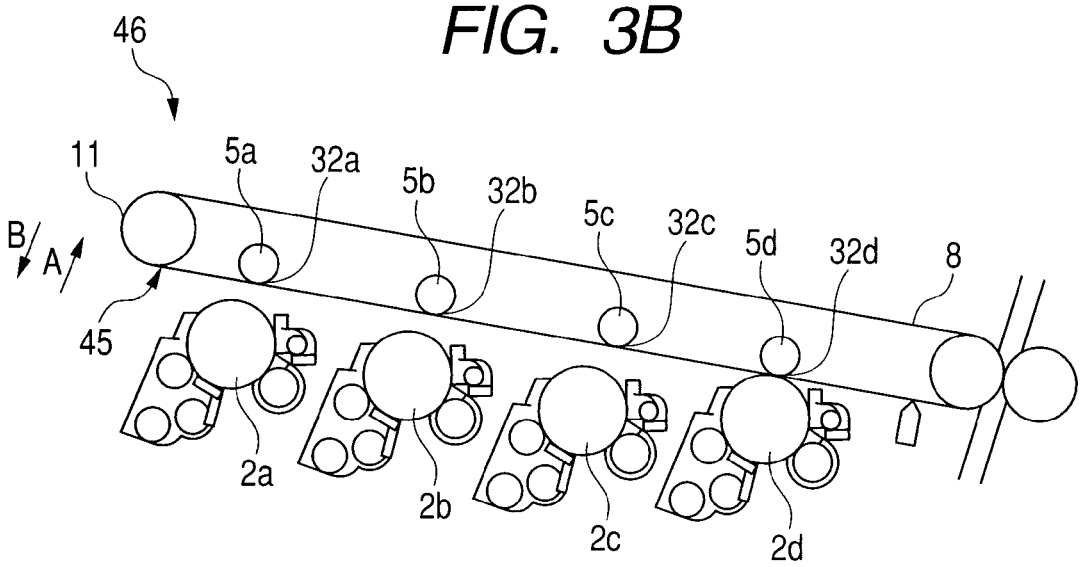

FIG. 3B is a view illustrating states of an image forming portion and the primary transfer portions during image formation in monochrome mode of a single color of black.

Due to a driving force transmitted from the separation motor 47, the tension roller 11 and the transfer rollers 5*a* to 5*c* of colors (yellow, magenta, cyan) not used move in the direction indicated by the arrow A of FIG. 3B. Then, in the primary transfer portions 32*a* to 32*c*, the intermediate transfer belt 8 is separated from the photosensitive drums 2*a* to 2*c*, and only the photosensitive drum 2*d* contacts the intermediate transfer belt 8.

When the intermediate transfer belt 8 and the photosensitive drums 2*a* to 2*c* are separated, the monochrome mode detecting sensor 46 is turned on to send a detection signal to the CPU 171. The separated state prevents the photosensitive drums 2*a* to 2*c* and the intermediate transfer belt 8 from being scraped due to rubbing during the monochrome mode and the service life as the apparatus can be increased.

Further, in the separated state, the rotation of the photosensitive drums 2*a* to 2*c* may be stopped, which eliminates the necessity of agitating a developer in the developing devices 4*a* to 4*c*. The developer is degraded as it is agitated. Therefore, the quality degradation of the developer may be suppressed by avoiding agitating of the developer in the separated state.

Further, in order to change the monochrome mode of FIG. 3B to the color mode of FIG. 3A, the tension roller and the transfer rollers 5*a* to 5*c* are moved in the direction indicated by the arrow B of FIG. 3B by driving the separation motor 47.

Then, the transfer rollers 5*a* to 5*c* contact and press the respective photosensitive drums 2*a* to 2*c* via the intermediate transfer belt 8 in the respective primary transfer portions 32*a* to 32*c*. The color mode detecting sensor 45 detects the contact state of the primary transfer portions 32*a* to 32*c*. Consequently, an image forming operation in color mode can be performed.

FIGS. 4A to 4D are sequence diagrams for illustrating a separation operation of the intermediate transfer belt 8.

FIGS. 4A to 4D illustrate, from above, the rotation speed of the separation motor 47, an output signal of the color mode detecting sensor 45, and an output signal of the monochrome mode detecting sensor 46 in the stated order. In color mode, the color mode detecting sensor 45 detects that the color mode is ON, and the monochrome mode detecting sensor 46 detects that the monochrome mode is OFF.

Figure 4A:
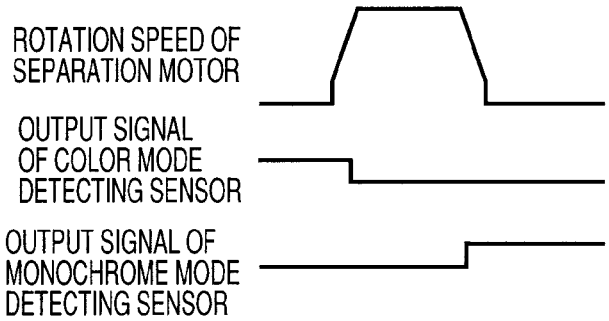
FIGS. 4A, 4B, 4C, and 4D are sequence diagrams for illustrating a separation operation of an intermediate transfer belt.

In the ordinary separation operation, as illustrated in FIG. 4A, the separation motor 47 is stopped when the monochrome mode detecting sensor 46 is turned on within a predetermined period of time from the time when the separation motor 47 starts being driven.

Figure 4B:
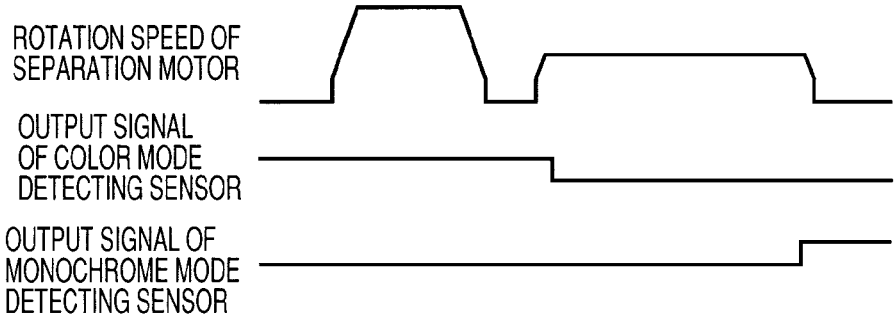

When a load for pivotally moving the tension roller 11 and the transfer rollers 5*a* to 5*c* has increased due to aging degradation or the like, the sequence operation as illustrated in FIG. 4B is performed. When the monochrome mode detecting sensor 46 is not turned on within a predetermined period of time after the separation motor 47 is driven, the separation motor 47 is stopped once.

After that, the separation motor 47 is driven again. However, the rotation speed of the separation motor 47 is set to be lower than that during the first driving. By setting the rotation speed lower, the output torque of the motor increases, and hence, the ratio at which the separation operation can be performed increases. Thus, the image forming apparatus 1 can be prevented from being unusable.

Further, considering the possibility that a sudden increase in load occurs, the separation motor 47 may be driven in the second driving at the same speed as that of the first driving. If the monochrome mode detecting sensor 46 still is not turned on within a predetermined period of time, the rotation speed of the separation motor 47 during the third driving may be set to be lower than that of the separation motor 47 during the first driving and the second driving as illustrated in FIG. 4D.

Further, in a case of changing the monochrome mode to the color mode, the same sequence as the above is performed. However, in this case, the state of the color mode detecting sensor 45 and the state of the monochrome mode detecting sensor 46 become reversed.

Figure 5:
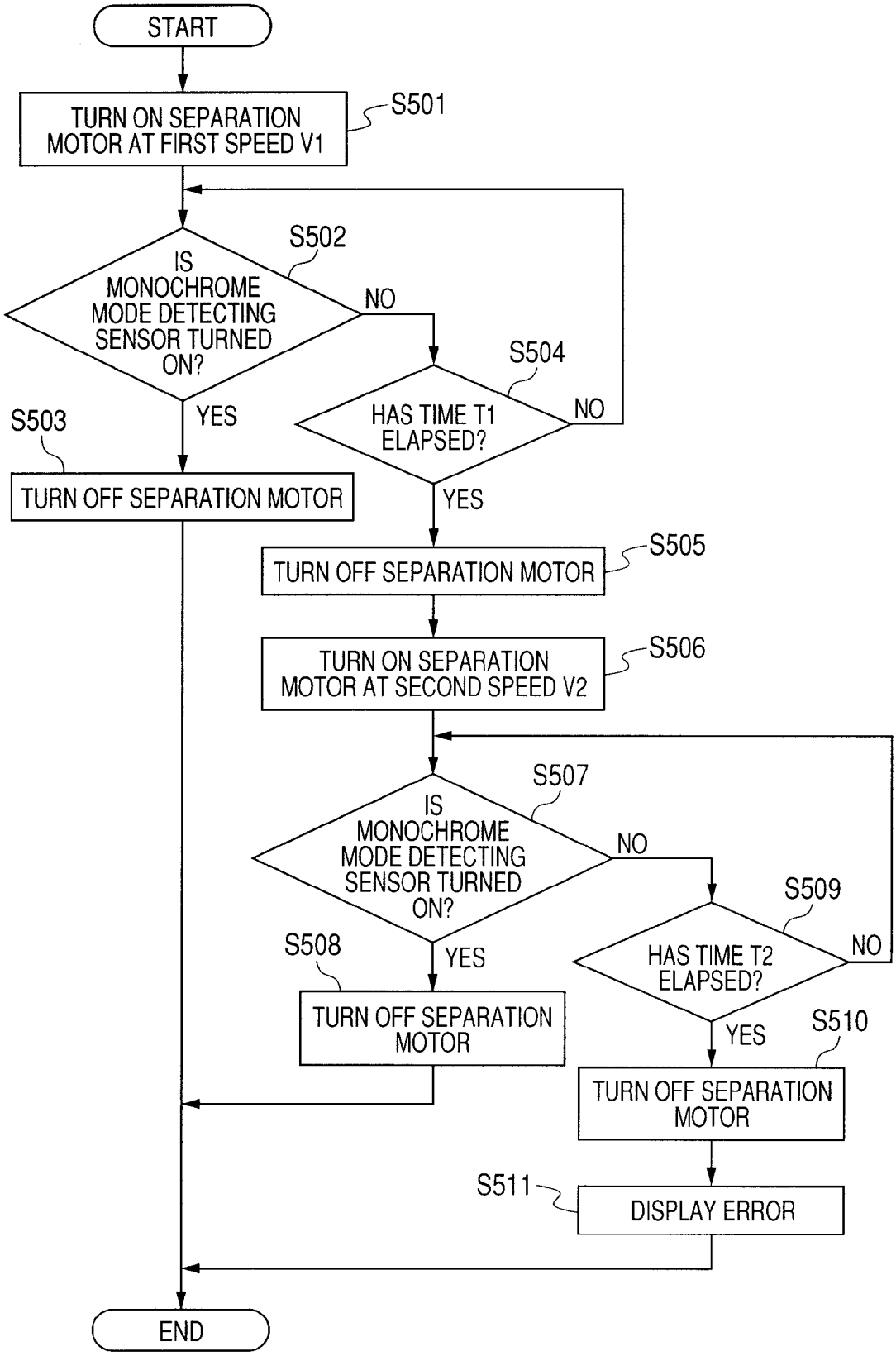
FIG. 5 is a flowchart for illustrating the separation operation of the intermediate transfer belt.

FIG. 5 is a flowchart illustrating a separation operation of the intermediate transfer belt 8.

A program for executing the flowchart is stored in the ROM 174 and is executed when read by the CPU 171.

In the color mode state of FIG. 3A, the CPU 171 drives the separation motor 47 at a speed V1 (first speed) (S501). Then, the CPU 171 determines whether or not the monochrome detecting sensor 46 is turned on (S502). More specifically, herein, the CPU 171 discriminates whether or not the intermediate transfer belt 8 is separated from the photosensitive drums 2*a* to 2*c*, based on the detection results of the monochrome mode detecting sensor 46.

When the monochrome mode detecting sensor 46 is turned on, the CPU 171 stops the driving of the separation motor 47 (S503). At this time, the CPU 171 completes the control flow, because the mode is shifted to the monochrome mode of FIG. 3B.

In Step S502, when the monochrome mode detecting sensor 46 is not turned on, the CPU 171 determines whether or not a predetermined period of time T1 has elapsed from the time when the separation motor 47 starts being driven (S504). If the predetermined period of time T1 has not elapsed, the process returns to Step S502.

In Step S504, if the monochrome mode detecting sensor 46 is not turned on even when the predetermined period of time T1 has elapsed, the CPU 171 stops the separation motor 47 once (S505). After that, the CPU 171 changes the operation speed of the separation motor 47 to a speed V2 (second speed) and the separation motor 47 starts being driven again (S506). The speed V2 is set to be lower than the speed V1. In this embodiment, the speed V2 is set to be a half of the speed V1.

After that, the CPU 171 determines whether or not the monochrome mode detecting sensor 46 is turned on (S507). When the monochrome mode detecting sensor 46 is turned on, the CPU 171 stops the driving of the separation motor 47 (S508). At this time, the CPU 171 completes the control flow, because the mode is shifted to the monochrome mode of FIG. 3B.

In Step S507, when the monochrome mode detecting sensor 46 is not turned on, the CPU 171 determines whether or not a predetermined period of time T2 (second predetermined time) has elapsed (S509). Herein, the predetermined period of time T2 is set to be longer than the predetermined period of time T1. In this embodiment, the predetermined period of time T2 is set to be twice the length of the predetermined period of time T1. In Step S509, when the predetermined period of time T2 has not elapsed, the process returns to Step S507.

In Step S509, if the monochrome mode detecting sensor 46 is not turned on even when the predetermined period of time T2 has elapsed, the CPU 171 stops the separation motor 47 (S510). Then, the CPU 171 performs display indicating that an error has occurred, in the display portion provided in the operating portion 172 (S511) and finishes the control flow.

Herein, when an error has occurred, the display portion provided in the operating portion 172 may display a screen allowing the user to select whether to inhibit or permit an image forming operation. In the case of permitting the image forming operation, the monochrome mode is performed by allowing the intermediate transfer belt 8 and the photosensitive drums 2*a* to 2*d* to contact each other. With such a configuration, the needs of users who highly evaluate the increase in service life of the image forming apparatus 1 and the needs of users who desire to prevent the occurrence of downtime may be satisfied respectively.

FIG. 5 is a flowchart corresponding to the operations of FIGS. 4A and 4B. However, even the operations of FIGS. 4C and 4D follow the same flow as that of FIG. 5, except that only one driving of the motor at the speed V1 increases.

Further, in FIG. 5, the separation operation when the color mode is changed to the monochrome mode is described. The same also applies to the contact operation when the monochrome mode is changed to the color mode. Specifically, the image forming apparatus 1 is operated in the same sequence if the monochrome mode detecting sensor 46 is replaced by the color mode detecting sensor 45 in FIG. 5.

Figure 4C:
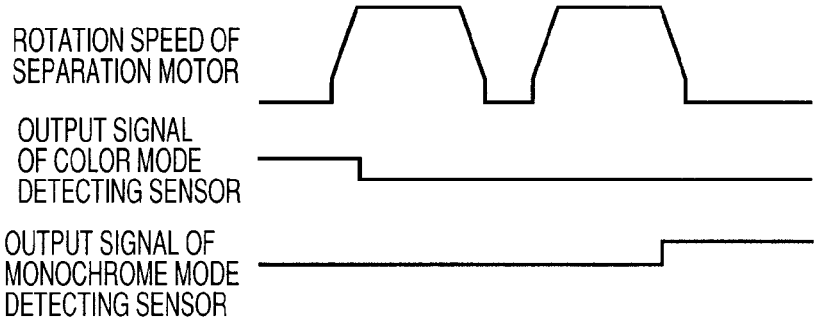
Figure 4D:
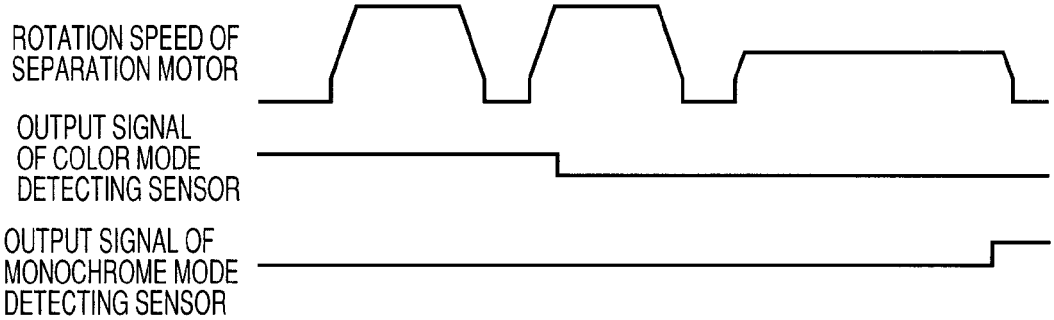

Further, even in this case, considering the possibility that a sudden increase in load has occurred, the speed of the second driving of the motor may be set to be the same as that of the first driving of the motor, as illustrated in FIG. 4C. In this case, if the color mode detecting sensor 45 still is not turned on within a predetermined period of time nonetheless, the speed of the third driving of the motor is set to be lower as illustrated in FIG. 4D.

As described above, according to this embodiment, the speed V1 in Step S506 is set to be lower than the speed V2 in Step S501, and hence, the output torque of the motor can be increased during the second driving of the separation motor 47. Thus, by controlling the separation motor 47, the ratio at which the separation operation can be performed during the second driving increases even if the separation operation cannot be performed during the first driving of the separation motor 47, which can prevent the image forming apparatus 1 from being unusable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-159900, filed Jul. 6, 2009, which is hereby incorporated by reference herein in its entirety.

What is claimed is:

1. An image forming apparatus, comprising:

a plurality of image bearing members configured to bear toner images;

an intermediate transfer member configured to contact the plurality of image bearing members so that the toner images borne on the plurality of image bearing members respectively are transferred to the intermediate transfer member;

a drive unit configured to cause at least one of the plurality of image bearing members and the intermediate transfer member to be separated from each other or to contact each other; and a control unit configured to control the drive unit so that the drive unit starts a separation operation of separating the at least one of the plurality of image bearing members and the intermediate transfer member from each other at a first speed, and when the at least one of the plurality of image bearing members and the intermediate transfer member are not separated from each other within a predetermined period of time from the start of the separation operation, the drive unit performs the separation operation at a second speed lower than the first speed.

2. An image forming apparatus according to claim 1, wherein the control unit controls the drive unit so that the drive unit starts a contact operation of causing all the plurality of image bearing members and the intermediate transfer member to contact each other at a first speed, and when all the plurality of image bearing members do not contact the intermediate transfer member within a predetermined period of time from the start of the contact operation, the drive unit performs the contact operation at a second speed lower than the first speed.

3. An image forming apparatus according to claim 1, further comprising a display unit configured to display information regarding the image forming apparatus, wherein the control unit causes the drive unit to perform the separation operation at the second speed, and after that, when the at least one of the plurality of image bearing members and the intermediate transfer member are not separated from each other within a second predetermined period of time longer than the predetermined period of time, the control unit causes the display unit to display that an error occurs.

4. An image forming apparatus according to claim 3, wherein the control unit causes the display unit to display a screen that allows a user to select whether to inhibit or permit an image forming operation, when the error occurs.

5. An image forming apparatus according to claim 1, further comprising a sensor configured to detect a separated state between the at least one of the plurality of image bearing members and the intermediate transfer member, wherein the control unit discriminates whether or not the at least one of the plurality of image bearing members and the intermediate transfer member are separated from each other, based on a detection result of the sensor.

6. An image forming apparatus according to claim 1, wherein the control unit controls the drive unit so that, in a case of a monochrome mode, the drive unit causes one of the plurality of image bearing members used in an image forming operation and the intermediate transfer member to contact each other and causes the plurality of image bearing members other than the one used in the image forming operation and the intermediate transfer member to be separated from each other, and in a case of a color mode, the drive unit causes all the plurality of image bearing members and the intermediate transfer member to contact each other.

* * * * *